US005579960A

United States Patent [19]

Scott

[11] Patent Number: 5,579,960

[45] Date of Patent: Dec. 3, 1996

[54] AIR POWERED DISPENSING PEN FOR VISCOUS FLUIDS

[76] Inventor: Richard R. Scott, 5326 N. Lydia, Kansas City, Mo. 64118

[21] Appl. No.: 582,226

[22] Filed: Jan. 3, 1996

Related U.S. Application Data

[63] Continuation of Ser. No. 236,960, May 2, 1994, abandoned.

[51] Int. Cl.[6] ..... B65D 83/00

[52] U.S. Cl. ..... 222/397; 401/188 R; 401/188 A

[58] Field of Search ..... 401/188 R, 188 A; 222/389, 397

[56] References Cited

U.S. PATENT DOCUMENTS

| | | | |
|---|---|---|---|
| 1,782,681 | 11/1930 | Foss et al. | 401/188 R |
| 3,258,176 | 6/1966 | Raczynski | 222/397 |
| 3,871,553 | 3/1975 | Steinberg | 222/397 X |
| 3,921,858 | 11/1975 | Bemm | 401/188 R X |
| 4,678,107 | 7/1987 | Ennis, III | 222/386.5 |
| 5,022,563 | 6/1991 | Marchitto et al. | 222/327 |

OTHER PUBLICATIONS

EFD Catalogue 92/93.
Composite Applicator article from "The Engravers Journal" Nov./Dec. 1979.
Glenmark brochure.
Courtaulde Aerospace/ Semco catalogue
Tridak catalogue.
Philip Fishman Bulletin 104.
Techon Systems catalogue.
Techon Systems brochure.
I & J Fisnar catalogue.

*Primary Examiner*—Steven A. Bratlie

[57] ABSTRACT

A pneumatic dispenser for viscous fluids including a tubular pen barrel, a dispensing nozzle on one end of the pen barrel, and a pen cap constructed to sealingly receive the pen barrel. The pen cap also includes an air line connection and venturi arrangement so that when supplied with compressed air, air flow through the venturi reduces pressure in the pen and holds fluid in the pen. Interrupting air flow through the venturi causes pressure to increase in pen and fluid to be extruded through pen nozzle.

2 Claims, 3 Drawing Sheets

AIR POWERED DISPENSING PEN FOR VISCOUS FLUIDS

This application is a continuation of Ser. No. 08/236960 filed May 2, 1994, now abandoned.

BACKGROUND

1. Field of Invention

This invention relates to dispensers for viscous fluids and more particularly to a dispensing pen which is operative for effectively and accurately dispensing controlled amounts of a viscous fluid.

2. Description of Prior Art

Currently, the most common type of dispenser for viscous fluids is the plastic squeeze bottle. While they are economical to produce, they are limited in the length of continuous line they can extrude before they must be allowed to return to their original shape. This introduces air bubbles into the fluid which can be extruded in subsequent use. Start and stop blobs and occasional bubbles are common problems. Also, many people with arthritis, carpal tunnel syndrome, or other wrist or hand problems find it difficult and tiresome to exert the constant pressure necessary to extrude a nice even line.

Also on the market are miniature caulk guns. These use medical type syringes for barrels and a ratchet trigger assembly to advance a piston for extruding a fluid. From the hand's position on the trigger these devices lack precise control over the tip. Like the squeeze bottle they are limited in the length of continuous line they can produce. Also, constant pressure must be maintained to produce an even line and hand fatigue is again a problem.

Another approach, used mainly in industry, is a dispensing pen that has a separate reservoir containing the fluid which is pressurized with air. The fluid is forced through a tube to a hand-held instrument containing a control valve. While working effectively, this dispenser requires a regulated air supply and is difficult to clean between fluid changes. To accomplish cleaning, the valve body must be disassembled and the reservoir and supply tube must be emptied and flushed.

A fourth, and the most expensive approach, is another air powered device. Basically, this is a syringe for holding the fluid fitted with a cap and an air line. This air line is connected to a control box hooked to a regulated air supply. The control box contains a venturi apparatus, so by means of a foot switch the operator can pressurize the syringe and extrude fluid through the tip, or release the switch and create a partial vacuum in the syringe and stop all flow of material. These units work well, but are expensive by themselves, and in addition require a regulated air supply. This amount of equipment can be cumbersome as well if weight or space is a consideration.

OBJECTS AND ADVANTAGES

Accordingly, several objects and advantages of my dispenser are its ability to produce long, continuous lines, without start and stop blobs or bubbles, and without having to squeeze a bottle or trigger. My dispenser has further been designed to allow fingertip control of both the movement of the pen and the flow of fluid. The pen barrel and nozzle are the only elements that come in contact with the fluid and they are readily changeable and easy to clean. My dispenser also limits post extrusion using a partial vacuum as in the most expensive industrial dispensers. However, my dispenser accomplishes this by a venturi incorporated in the pen cap and controlled by fingertip. Also, where other dispensers require a regulated air supply, my dispenser operates with a conventional, inexpensive aquarium pump.

Thus, my dispenser produces lines that are far superior to squeeze bottles and caulking gun type dispensers. And, being air powered, it causes little or no hand fatigue. Compared to other pneumatic dispensers, my dispenser is lighter, more compact, simpler to operate, easier to clean, and much more economical. And it produces lines comparable to any dispenser available. Further objects and advantages will become apparent from a consideration of the drawings and ensuing description.

DRAWING FIGURES

In the drawings, closely related figures have the same number, but different alphabetical suffixes.

DESCRIPTION FIGS. 1–3

Figure 1:
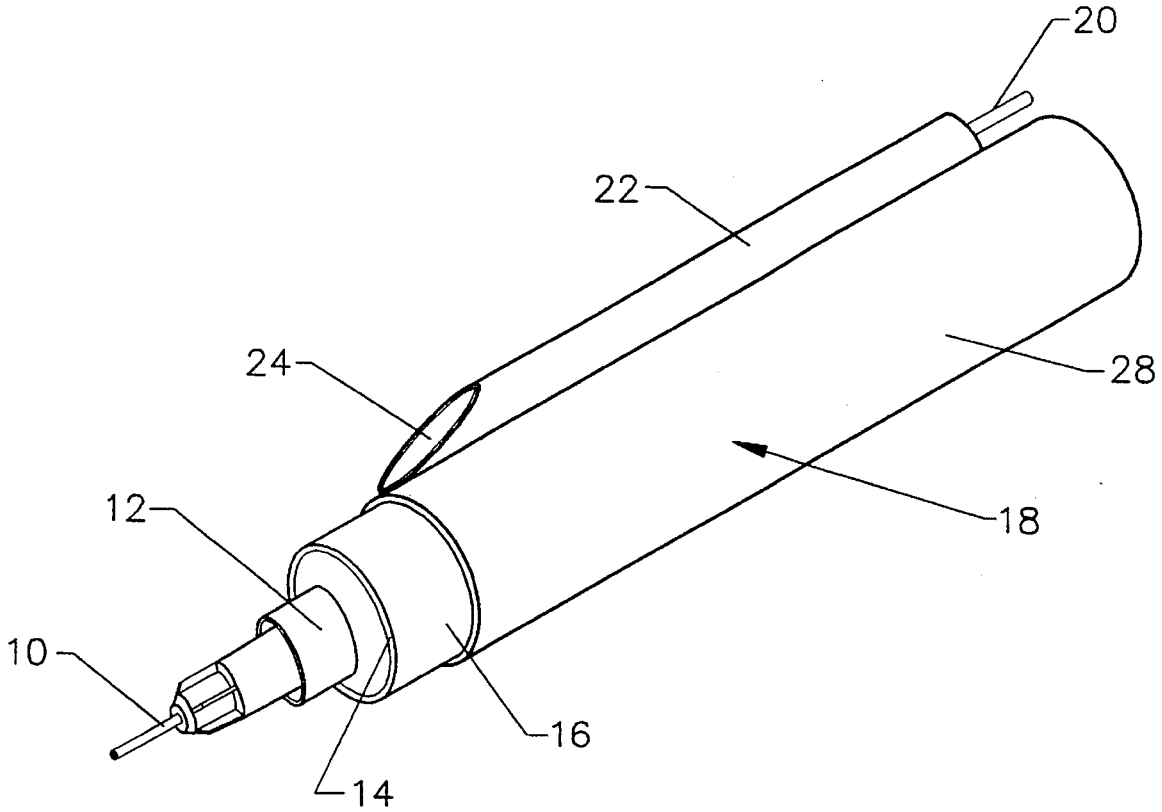
FIG. 1 is a perspective view of the dispensing pen.

FIG. 1 shows a perspective view of my dispensing pen 18. A nozzle 10 is a disposable hypodermic needle where the stainless steel canula tubing has been square cut leaving 1 c.m. of the tubing and the remaining end deburred and chamfered. A luer lock connector 12 connects nozzle 10 to a 12 c.c. syringe or a pen barrel 16. Pen barrel 16 has been machined with a male thread 26—1.9 c.m. dia., 6.3 threads/c.m. (¾"NF16). A pen cap 28 has been machined with a female thread 30—1.9 c.m. dia., 6.3 threads/c.m. (¾"NF16). Male thread 26 and female thread 30 allow connection of pen barrel 16 and pen cap 28. A vinyl seal 14 is a 2 c.m. long section of vinyl tubing, 1.9 c.m. O.D., 1.6 c.m. I.D. Vinyl seal 14 is situated around bottom end of pen barrel 16 to effect an airtight seal with pen cap 28.

Figure 2A:
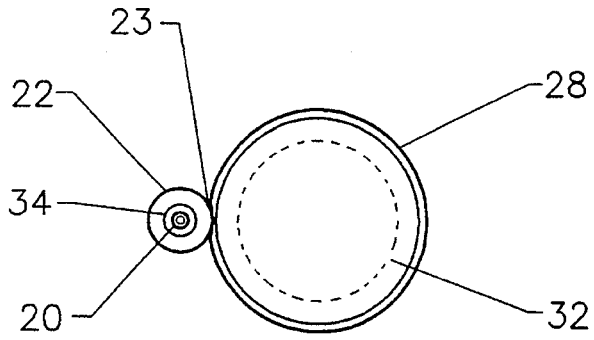
FIG. 2A is a top view of the pen cap.

FIG. 2-B shows an air line connector 20 which is a 1.6 c.m. long brass tube 0.16 c.m. O.D., 0.08 c.m. I.D. This air line connector 20 is reduced on one end to 0.05 c.m. I.D. by an orifice 36. Air line connector 20 is glued into one end of a control tube 22 with the addition of a vinyl bushing 34. Control tube 22 is a 9.4 c.m. long polystyrene tube, 0.64 c.m. O.D., 0.32 c.m. I.D. Vinyl bushing 34 is a 0.64 c.m. long vinyl tube, 0.32 c.m. O.D., 0.16 c.m. I.D. A pressure transfer hole 38, 0.16 c.m. diameter is located in control tube 22 with its edge adjacent to orifice 36. Adjacent to opposite edge of pressure transfer hole 38 is a movable venturi element 40. Movable venturi element 40 is a 0.8 c.m. long vinyl tube 0.32 c.m. O.D., 0.16 c.m. I.D. A vein 23, 0.64 c.m. radius, is routed. 0.12 c.m. deep, longitudinally, the entire length of pen cap 28. This is best shown in FIG. 2A. Pen cap 28 is constructed of a 10 c.m. section of PVC tube; 21 m.m. O.D., 18 m.m. I.D. (½" SDR 13.5 PVC pipe).

Figure 2B:
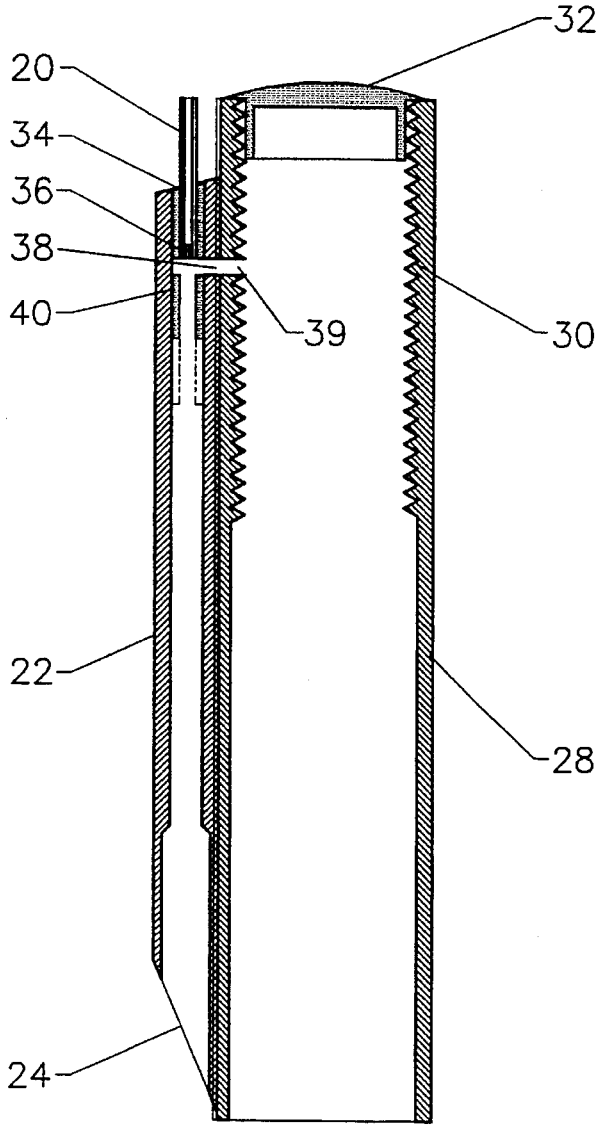
FIG. 2B is a side view cross-section of the pen cap.

FIG. 2B shows a hole 39, 0.16 c.m. diameter, drilled in the center of vein 23 at a distance from the end so that when hole 38 and hole 39 are lined up, a flow control port 24 will be flush with bottom edge of pen cap 28. Control tube 22 is glued in this position with special attention to forming an airtight seal around hole 38 and hole 39. Control tube 22 has been reamed to 0.48 c.m. I.D. and cut at a 22 degree angle to form control port 24. A pen cap end plug 32 is glued in threaded end of pen cap 28. All glue used is waterproof epoxy. The open end of pen cap 28 has been drilled to a diameter to slidably receive pen barrel 16 shown in FIG. 3.

Figure 3:
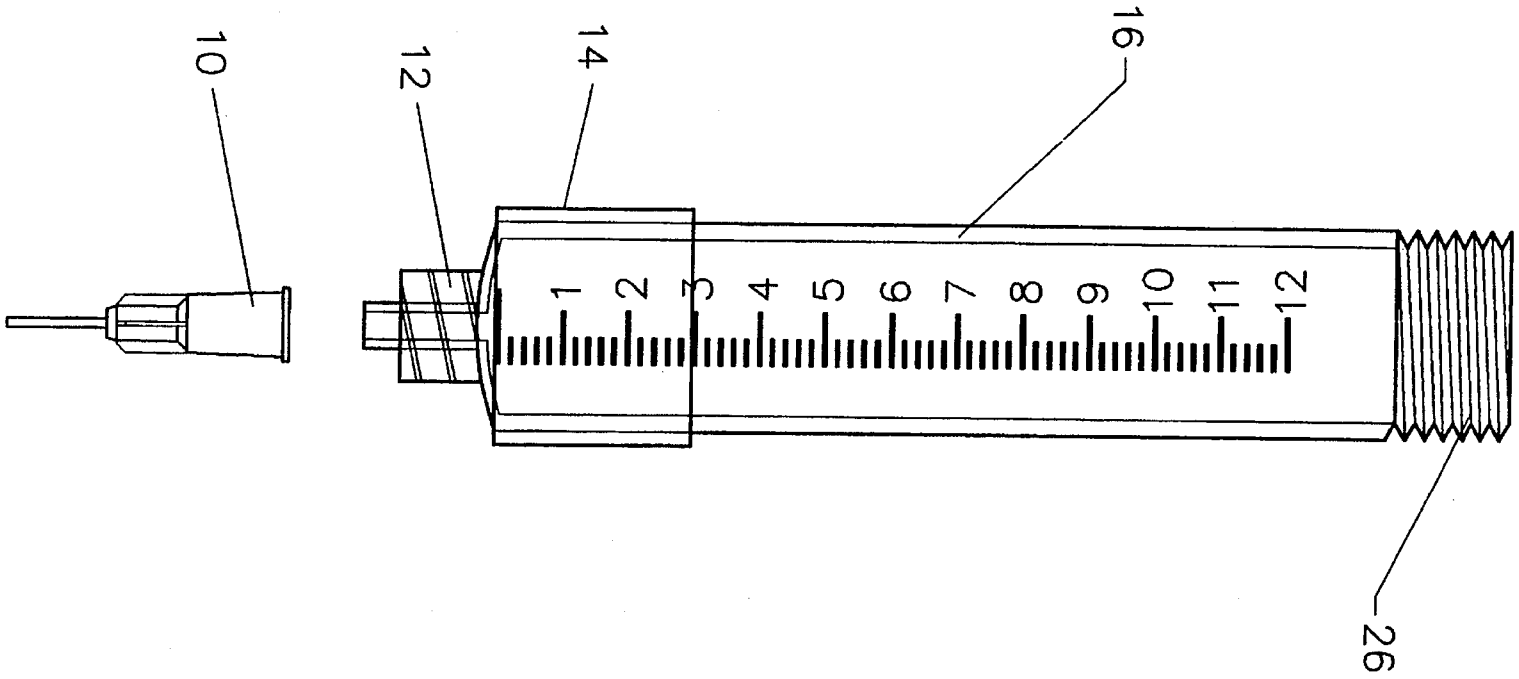
FIG. 3 is a side view of the pen barrel and nozzle.

Operation FIGS. 1–3

The manner of operation of dispensing pen 18 is to connect a 0.32 c.m. O.D., 0.16 c.m. I.D. vinyl tubing (not shown) from air connector 20 to a conventional aquarium pump (not shown), supplying air at a rate of 3–4 liters per minute at a pressure of 0.18 KG–0.3 KG per $cm^2$. Next, remove pen barrel 16 and fill with up to 12 c.c. of desired fluid (glue, paint, fabric paint, dye resist, etc.). Reinsert pen barrel 16 into pen cap 28 and screw until vinyl seal 14 seats against pen cap 28 forming an airtight seal. Dispensing pen 18 should be held with point down when loaded to keep fluid in pen barrel 16. Air flow through orifice 36 and movable venturi element 40 will create a partial vacuum in pen cap 28 and prevent extrusion of fluid through nozzle 10. Movable venturi element 40 is slidable in control tube 22 for adjusting vacuum to accommodate variations in aquarium pump outputs. Pen should be held so forefinger rests near flow control port 24. This port has been reamed and cut on an angle to facilitate its use. Covering port 24 will cause pressure to rise in pen cap 28 via pressure transfer hole 38 and pressure transfer hole 39 and fluid will be extruded through nozzle 10. Uncovering flow control port 24 will stop flow of fluid. Pen barrel 16 and nozzle 10 are easily cleaned with a 12 c.c. syringe plunger (not shown).

Thus the reader will see that the dispensing pen 18 of the invention provides a simple, reliable, and economical device that can be used by almost anyone. While my above description contains many specificities, these should not be construed as limitations on the scope of the invention, but rather as an exemplification of one preferred embodiment thereof. Many other variations are possible. For example, pen cap 28 and control tube 22 could be molded as one piece. Control tube 22 could even be contained entirely in the side wall of pen cap 28.

Accordingly, the scope of the invention should be determined not by the embodiment illustrated, but by the appended claims and their legal equivalents.

I claim:

1. A dispenser for a viscous fluid comprising:

a) a tubular barrel member having a chamber therein containing said viscous fluid, said tubular barrel member having a first end and a second end, opposite of each other;

b) a nozzle means defining a dispensing nozzle having a reduced dispensing aperture therein, said nozzle means communicating with said first end of said tubular barrel member for receiving said viscous fluid through said reduced dispensing aperture when pressure is applied to said viscous fluid; and c) a pen cap element which sealably receives said second end of said tubular barrel member and includes: a venturi located adjacent to a pressure transfer hole and a valve means for controlling air flow from a compressed air source so that when said valve means is open, air flows through said venturi and a partial vacuum is created in said tubular barrel member via said pressure transfer hole, and when said valve means is closed pressure increases in said tubular barrel member through said pressure transfer hole and said viscous fluid is extruded through said nozzle means.

2. The dispensing pen of claim 1 wherein said venturi consists of an orifice and a movable venturi element that enable vacuum to be adjusted.

* * * * *